US006543573B2

(12) United States Patent
Ishihara et al.

(10) Patent No.: US 6,543,573 B2
(45) Date of Patent: Apr. 8, 2003

(54) SPEAKER UNIT, SPEAKER SYSTEM, AND SPEAKER DIAPHRAGM MANUFACTURING METHOD

(75) Inventors: Yoshihisa Ishihara, Tochigi-ken (JP); Takeshi Aoki, Imaichi (JP); Satoshi Iwasaki, Utsunomiya (JP); Hirotoshi Kakuta, Utsunomiya (JP)

(73) Assignee: JSP Corporation, Tokyo (JP)

( * ) Notice: Subject to any disclaimer, the term of this patent is extended or adjusted under 35 U.S.C. 154(b) by 104 days.

(21) Appl. No.: 09/730,742

(22) Filed: Dec. 7, 2000

(65) Prior Publication Data

US 2001/0050194 A1 Dec. 13, 2001

(30) Foreign Application Priority Data

Dec. 28, 1999 (JP) ..... 11-372705

(51) Int. Cl.[7] ..... G10K 13/00; H04R 7/00
(52) U.S. Cl. ..... 181/167; 521/79; 521/138
(58) Field of Search ..... 181/167, 173, 181/168, 169, 170; 521/79, 138; 428/304.4

(56) References Cited

U.S. PATENT DOCUMENTS 3,592,290 A * 7/1971 Armstrong ..... 181/151
5,405,563 A * 4/1995 Hayashi et al. ..... 264/237
5,744,761 A * 4/1998 Ogura et al. ..... 181/167
5,854,294 A 12/1998 Hirosawa et al.
6,191,178 B1 * 2/2001 Shioya et al. ..... 521/182
6,256,937 B1 * 7/2001 Kogure et al. ..... 52/101

FOREIGN PATENT DOCUMENTS

EP 0 785 057 A2 * 7/1997 ..... B29C/44/50
JP 57132499 A * 8/1982 ..... H04R/7/08
JP 06261392 A * 9/1994 ..... H04R/7/02
JP 08066953 3/1996
JP 08174780 7/1996
JP 10310658 A * 11/1998 ..... C08J/9/14
JP 10329206 A * 12/1998 ..... B29C/51/18

* cited by examiner

*Primary Examiner*—Robert E. Nappi
*Assistant Examiner*—Edgardo San Martin
(74) *Attorney, Agent, or Firm*—Sherman & Shalloway

(57) ABSTRACT

The present invention provides a speaker unit comprising a diaphragm of 0.5 to 10 mm thick aromatic polycarbonate with a density of 0.03 to 0.6 g/cm$^3$, and a mechanism for driving the diaphragm. The aromatic polycarbonate used for the diaphragm is preferably derived from bisphenol with a viscosity average molecular weight of 25,000 to 70,000. The invention further provides a speaker system comprising such a speaker unit attached to a cabinet and a method for manufacturing the speaker diaphragm.

13 Claims, 1 Drawing Sheet

SPEAKER UNIT, SPEAKER SYSTEM, AND SPEAKER DIAPHRAGM MANUFACTURING METHOD

BACKGROUND OF THE INVENTION

1. Field of the Invention

The present invention relates to a speaker unit, a speaker system comprising such a speaker unit, and a method for manufacturing a speaker diaphragm.

2. Description of the Related Art

Light-weight materials with high modulus and substantial internal loss are considered suitable for speaker diaphragms. Materials based on pulp starting materials have been most frequently used conventionally as speaker diaphragms because of their light weight and their suitable internal loss. However, with recent concerns over the environmental destruction resulting from deforestation, even more light-weight materials with high modulus have been developed. Many speaker diaphragms of synthetic resins, in particular, have been developed, and it is known that weight can be reduced and that the modulus can be improved by using synthetic resins and foams such as polystyrene or polypropylene, as well as composites of such synthetic resins or synthetic resin foams and other materials, for such diaphragms.

New speaker units are required to have higher amp output and to withstand use in a variety of environments such as car stereo speaker units which are used under oppressive conditions involving changing temperatures. Speaker diaphragms should therefore have high heat resistance and undergo fewer changes in acoustic properties due to changes in temperature. However, even though polystyrene resins have high modulus and are inexpensive, their heat resistance is problematic, and a resulting problem is that diaphragms made of polystyrene resin suffer considerable loss of modulus at elevated temperatures. Although polypropylene resins are crystalline resins with a relatively high melting point, the resin properties are considerably temperature-dependent. A resulting problem is that changes in temperature can cause changes in the acoustics of diaphragms made of polypropylene resin. Additionally, an advantage of diaphragms comprising polystyrene resin or polypropylene resin foams is that they weigh less than diaphragms made of unfoamed synthetic resins, yet the rigidity is lower.

SUMMARY OF THE INVENTION

In view of the foregoing, an object of the present invention is to provide a better speaker diaphragm that weighs less, that has higher rigidity and modulus, and that has fewer changes in properties as a result of changes in temperature, as well as a speaker unit featuring the use of such a diaphragm, and a speaker system comprising such a speaker unit.

The speaker unit of the present invention is a speaker unit comprising a diaphragm and a mechanism for driving the diaphragm, the aforementioned diaphragm comprising a 0.5 to 10 mm thick aromatic polycarbonate resin foam with a density of 0.03 to 0.6 g/cm$^3$. The diaphragm of the speaker unit in the present invention comprises the steps of foaming an aromatic polycarbonate resin foam sheet or plate, and the elastic modulus in tension of said foam sheet or plate is preferably at least 1 MPa at temperatures of 25° C., 50° C., 80° C., and 105° C., and the tan δ of said foam sheet or plate is preferably at least 0.02 at a temperature ranging from 25 to 105° C. during measurement of the dynamic viscoelasticity in bending tests giving 1 Hz frequency oscillation strain. The diaphragm comprises the steps of foaming an aromatic polycarbonate resin foam sheet or plate, and the mean cell diameter of said foam sheet or plate is preferably 0.05 to 1 mm, and the amount of foaming agent left over in the foam forming said diaphragm is preferably no more than 0.3 mol/kg. The aromatic polycarbonate resin forming the diaphragm in the speaker unit of the present invention preferably comprises an aromatic polycarbonate resin derived from bisphenol, and an aromatic polycarbonate resin with a viscosity average molecular weight of 25,000 to 70,000 is preferred. The percentage of open cells in the aromatic polycarbonate resin foam forming the diaphragm in the speaker unit of the present invention is preferably no more than 50%. The diaphragm of the speaker unit in the present invention can comprise a film or sheet of an unfoamed thermoplastic resin laminated to at least one side. The speaker system of the present invention comprises a speaker unit as described above attached to a cabinet. The method for manufacturing a speaker diaphragm in the present invention comprises the steps of forming a 0.5 to 10 mm thick aromatic polycarbonate resin foam sheet or plate with a density of 0.03 to 0.6 g/cm$^3$.

DESCRIPTION OF THE PREFERRED EMBODIMENTS

Figure 1:
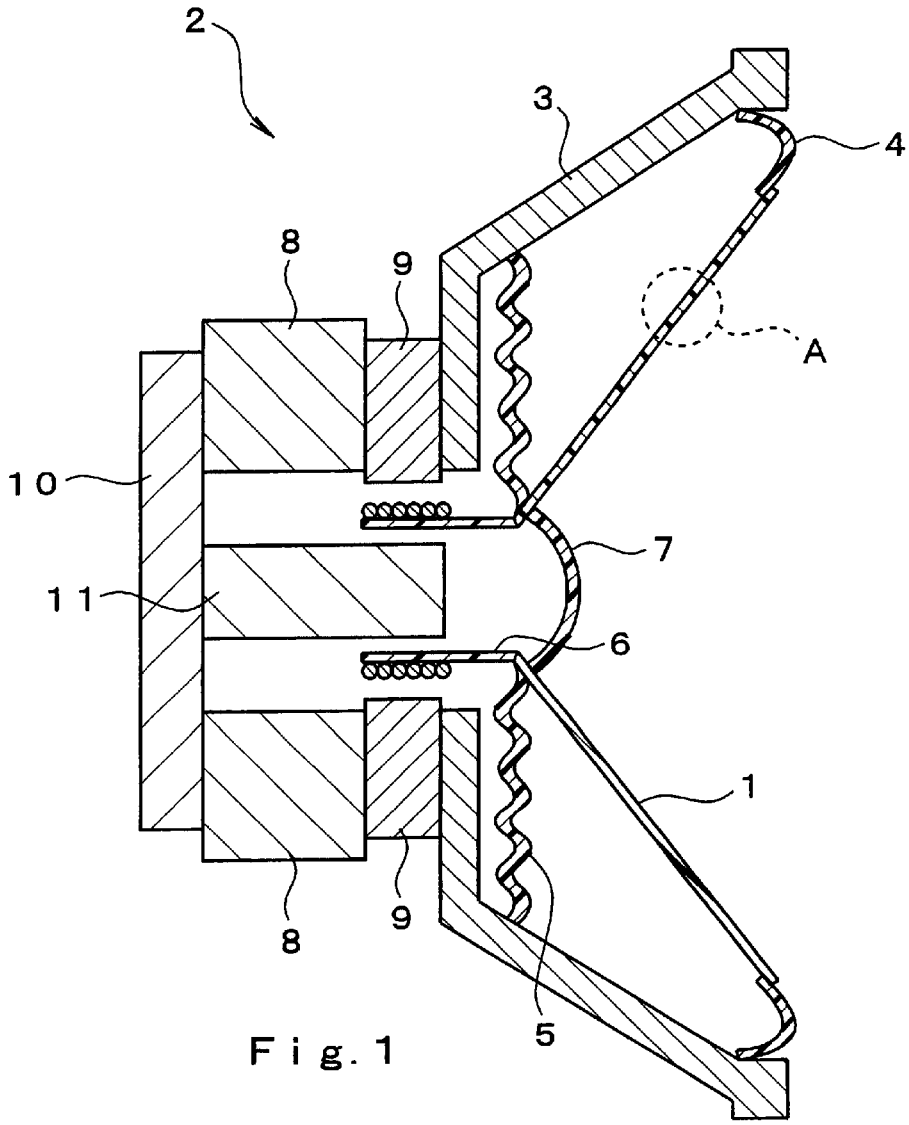
FIG. 1 illustrates an example of a speaker unit 2 of the present invention with a cone-shaped speaker diaphragm 1.
Figure 2:
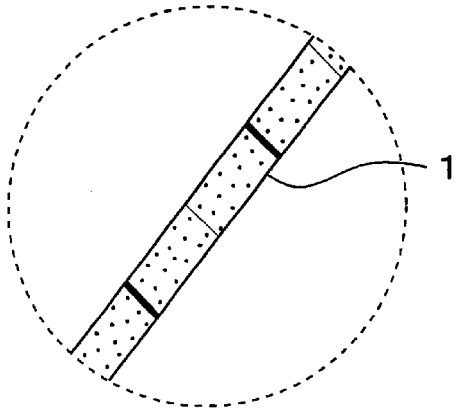
FIG. 2 is an enlarged view showing a detail of portion A of FIG. 1.

In FIG. 1, 3 is a frame, and 4 and 5 are an edge and a damper, respectively, supporting the diaphragm 1 on the frame 3. 6 is a voice coil attached to the diaphragm, and 7 is a center cup. 8 is a ring-shaped magnet, 9 is a plate, 10 is a yoke, and 11 is a pole.

The base resin of the aromatic polycarbonate resin foam used for the diaphragm 1 of the speaker unit 2 in the present invention contains at least 50 wt % aromatic polycarbonate, preferably at least 70 wt %, and even more preferably at least 80 wt %. Aromatic polycarbonates are polymers with carbonate ester bonds, synthesized primarily using (a) carbonyl halides, (b) carbonate esters, and (c) carbon dioxide or carbonates, where the carbons directly linked to the carbonate ester bonds are aromatic ring carbons. Aromatic polycarbonates can be obtained by methods for the ester interchange of carbonate esters such as dialkyl carbonates and aromatic dihydroxy compounds; methods in which carbonyl halides are allowed to act in the presence of alkalis on aromatic dihydroxy compounds; and the like. Among aromatic polycarbonates, bisphenol aromatic polycarbonates featuring the use of bisphenol as the aromatic dihydroxy compound are preferred because of their outstanding heat resistance and processability. Examples of bisphenol aromatic polycarbonates include aromatic polycarbonates derived from bisphenols such as 2,2-bis(4-oxyphenyl) propane (bisphenol A), 2,2-bis(4-oxyphenyl)butane, 1,1-bis (4-oxyphenyl)cyclohexane, 1,1-bis(4-oxyphenyl)isobutane, and 1,1-bis (4-oxyphenyl)ethane. Such aromatic polycarbonates can be used in combinations of two or more. The aromatic polycarbonates may also be copolyesters obtained using two or more different aromatic dihydroxy compounds. The molecular weight of the aromatic polycarbonate is preferably a viscosity average molecular weight of at least 25,000, and more preferably at least 28,000. The maximum viscosity average molecular weight should be about 70,000.

The viscosity average molecular weight is determined from a limiting viscosity according to the Schenell's formula:

$$[\eta]=1.23\times10^{-4}\times M^{0.83}$$

wherein [η] represents the limiting viscosity and M represents the viscosity average molecular weight. The limiting viscosity [η] is determined as follows. A sample is dissolved in methylene chloride at 20° C. to obtain solutions having varying concentrations C (g/100 $cm^3$). Specific viscosity $\eta_{sp}$ of each solution is measured using Ostwald viscometer. When the sample contains an insoluble matter as in a case of mixture of a polycarbonate resin with a polyethylene resin, the insoluble matter is removed by filtration and the filtrate is measured for the specific viscosity. $\eta_{sp}/C$ is then plotted against C. From the graph the limiting viscosity [η] is determined as follows.

$$[\eta]=\lim_{C\to 0}\eta_{sp}/C$$

In addition to the aromatic polycarbonate, it is also possible to introduce other resins, rubber, thermoplastic elastomers, and the like in a proportion of less than 50 wt % to the foamed base resin forming the diaphragm 1 in order to further improve the physical properties. For example, polyester resins such as polyethylene terephthalate and polybutylene terephthalate may be blended to provide alkaline resistance, to further improve heat resistance, to improve water resistance, and the like, and polystyrene resins, polyethylene resins, polycaprolactone resins, methacrylic acid resins, acrylonitrile-butadiene-styrene copolymers, methacrylic acid-butadiene-styrene copolymers, styrene-maleic acid copolymers, styrene-acrylic acid copolymers, styrene-acrylate ester-styrene block copolymers, styrene-butadiene-styrene copolymers, styrene-isoprene-styrene block copolymers, styrene-ethylene-butylene-styrene block copolymers, styrene-ethylene-propylene-styrene block copolymers, and the like can also be added as needed. An agent for improving compatibility is preferably used when such resins, rubber, and thermoplastic elastomers have low compatibility with aromatic polycarbonates.

The diaphragm 1 consists of a 0.5 to 10 mm thick foam based on the aforementioned aromatic polycarbonate resin, with a density of 0.03 to 0.6 g/$cm^3$, although the density is preferably 0.06 to 0.35 g/$cm^3$ and even more preferably 0.10 to 0.24 g/$cm^3$. A density less than 0.03 g/$cm^3$ or a thickness of less than 0.5 mm will result in rigidity that is too low and unsatisfactory sound reproduction, whereas a density greater than 0.6 g/$cm^3$ or a thickness of more than 10 mm will result in a diaphragm that is too heavy, and will not allow adequate sound reproduction to be achieved.

The diaphragm is manufactured by the aromatic polycarbonate resin foam sheet or plate forming. The foam sheet or plate (hereinafter referred to as sheet) has an elastic modulus in tension of preferably at least 1 MPa, and more preferably at least 1.5 MPa at temperatures of 25° C., 50° C., 80° C., and 105° C. The tan δ of the foam sheet is preferably at least 0.02, and more preferably at least 0.03, at a temperature ranging from 25 to 105° C., as determined during measurement of the dynamic viscoelasticity in bending tests giving 1 Hz frequency oscillation strain. An elastic modulus in tension of at least 1 MPa results in a speaker diaphragm with excellent rigidity, and is particularly good for sound reproduction. A tan δ of at least 0.02 at a temperature ranging from 25 to 105° C. ensures the prevention of decreases in sound pressure due to temperature changes such as that caused by heat generated by the diaphragm. With recent higher amp output in particular, speaker diaphragms frequently become hot. The speaker diaphragm 1 therefore have an elastic modulus in tension of preferably at least 1 MPa, and a tan δ of preferably at least 0.02 over a wide temperature range of 25 to 105° C. The maximum elastic modulus in tension is about 10 MPa, and the maximum tan δ is about 0.2.

The aforementioned elastic modulus in tension is determined in accordance with JIS K 7113 (1981) using a dumbbell-shaped Type 1 test piece (gauge length 40 mm) in JIS K 6301 (1975). The measurements are taken using the Tensilon tensile tester, Tensilon Module UTM-III-500 by Orientec Co., Ltd., under test conditions involving a distance of 70 mm between grips, a speed of testing 500 mm/min, and temperatures of 25, 50, 80, and 105° C. The elastic modulus in tension at each temperature is measured in an oven which is used to adjust the samples to the prescribed temperatures. To measure the elastic modulus in tension of the test pieces in the oven, the test pieces are set in the oven, the samples are held for 5 minutes at the prescribed temperature once that temperature (measuring temperature) has been reached in the oven, and the tensile test is conducted to determine the elastic modulus in tension. The aforementioned tanδ is determined by fabricating a foamed rectangular test piece that is 48 mm long and 6 mm wide, and that is as thick as the foam sheet, and by taking measurements of the test piece under the following conditions using the Solids Analyzer RSA II dynamic viscoelasticity measuring device by Rheometric Scientific F.E., Inc., and the affiliated 3-point bending measurement jig.

Temperature: 25 to 105° C.

Heating rate: 0.5° C./min

Bending strain: 0.1%

Bending oscillation frequency: 1 Hz (6.28 rad/sec)

Auto-tension adjustment function: 20–40 g

Grip interval of 3-point bending jig: 44.5 mm 3-point bending jig sample center clamp length: 4 mm 3-point bending jig sample center clamp width: 6 mm 3-point bending jig sample end clamp length: 4 mm 3-point bending jig sample end clamp width: 6 mm The test pieces are measured using the aforementioned dynamic viscoelasticity measuring device to obtain a continuous curve graph in which the temperature is indicated on the horizontal axis and the tans is indicated on the vertical axis. The values of tanδ shown in Table 1 below are those values of tanδ at temperatures of 25° C., 50° C., 80° C. and 105° C. on the curve graph thus obtained.

The values for the elastic modulus in tension and tan6 can be adjusted to within the aforementioned ranges by combining the physical properties of the base resin, the density of the foam, and structures such as the cell structure.

The mean cell diameter of the foam sheet is preferably 0.05 to 1 mm, and the amount of foaming agent left over in the foam (the diaphragm) is preferably no more than 0.3 mol/kg, and even more preferably no more than 0.15 mol/kg. The mean cell diameter is adjusted to between 0.05 and 1 mm in order to improve the mold processability, particularly the thermoformability, thereby ensuring that the target shape of the diaphragm is achieved, as well as better acoustic stability and a more attractive appearance of diaphragm. The amount of foaming agent left over in the foam forming the diaphragm is no more than 0.3 mol/kg in order to minimize changes over time in the diaphragm shape, dimensions, strength, and the like, as well as for better acoustic stability.

The mean cell diameter is determined in the following manner. A vertical cross section in the widthwise direction of the foam sheet is magnified under a microscope to obtain an enlargement of the prescribed magnification, and a base line 3000 $\mu$m long is drawn in the widthwise direction of the foam at a location 100 $\mu$m in the thicknesswise direction of the foam from the surface of the foam in the enlargement. The total number of cells intersecting the base line is then counted, and the mean cell diameter in the widthwise direction of the foam is determined by Equation (1) below. An enlargement of a vertical cross section is similarly obtained in the extrusion direction of the foam, a base line 3000 $\mu$m long is drawn in the extrusion direction at a location 100 $\mu$m in the thicknesswise direction of the foam from the surface of the foam in the enlargement, and the total number of cells intersecting the base line is counted to determine the mean cell diameter in the extrusion direction of the foam by Equation (1) below. The average of the mean cell diameters in the widthwise and extrusion directions is then used as the mean cell diameter of the foam sheet.

$$\text{Mean cell diameter } (\mu m) = 3000 \div \text{number of cells} \quad (1)$$

The amount of foaming agent left over in the foam can be determined by introducing a sample of foam into a lidded sample bottle containing toluene, immersing and stirring the sample for 24 hours to allow the foaming agent in the foam to dissolve in the toluene, then sampling the toluene containing the dissolved foaming agent with a microsyringe for analysis by gas chromatography, and then determining the amount based on an internal reference.

The percentage of open cells in the foam used for the diaphragm 1 of the speaker unit 2 is preferably no more than 50%, and more preferably no more than 30%. More than 50% open cells can result in lower durability and lower acoustics due to moisture absorption. The percentage of open cells in the foam is determined based on the apparent volume (Va ($cm^3$)) of the foam, the true volume (Vx ($cm^3$)) of the foam, the weight (W (g)) of the foam, and the density ($\rho$ ($g/cm^3$)) of the base resin of the foam. The apparent volume of the foam is the volume determined from the external dimensions of a sample. The true volume of the foam is the sum of the volume of the base resin forming the foam and the total volume of the cells of the closed cell portions in the foam. The volumetric percentage of the continuous cells (percentage of open cells) is thus determined by the following formula.

$$\text{Percentage of open cells } (\%) = (Va - Vx) \times 100 / (Va - W/\rho)$$

The samples used to determine the apparent volume, true volume, and weight of the foam are cut out from the foam forming the diaphragm.

The true volume of the foam is determined using an air comparison pycnometer in accordance with ASTM D-2856-70 (procedure C).

The foam sheet molded in the diaphragm 1 can be obtained by adding and kneading a foaming agent and an additive such as a cell nucleating agent as necessary with the aforementioned aromatic polycarbonate resin in an extruder, extruding the resulting foaming resin composition from the extruder, and foaming the composition in the form of a sheet. A flat die or circular die may be used to extrude the foaming resin composition from the extruder. When a flat die is used, the extruded and foamed material is drawn as it is passed through a shaping device such as a cold roll as needed, thereby giving foam in the form of a sheet or plate. When a circular die is used, the extruded and foamed tubular material can be passed over the surface of a cylindrical cooling device and cooled, and the tubular foam can be cut open along the extrusion direction, giving a foam in the form of a sheet. In either case, the resulting foamed sheet is furthermore passed through a heated furnace to be heated and cured, and the sheet is stretched in the extruded direction of the sheet, or the sheet can be stretched in both the extruded and widthwise directions, giving an appearance of foamed sheet with good smoothness.

When the foam sheet is extruded and foamed, the heat produced by the resin as a result of friction in the extruder is suppressed to prevent the resin temperature from becoming too high, or air is blown onto the surface of the foam sheet that has been extruded and foamed from the die, or the like, allowing foam with a low percentage of open cells to be obtained.

Both physical foaming agents and decomposing types of foaming agents can be used as foaming agents to produce the foam sheet, but since the use of decomposing types of foaming agents alone can be hard to result in foam sheet with a high foaming rate, such decomposing types of foaming agents are preferably combined with physical foaming agents. Examples of physical foaming agents which may be used include inorganic types such as carbon dioxide, nitrogen, and air; and organic types, including lower aliphatic hydrocarbons such as propane, n-butane, i-butane, n-pentane, i-pentane, and hexane; lower alicyclic hydrocarbons such as cyclobutane and cyclopentane; aliphatic lower monohydric alcohols such as methyl alcohol and ethyl alcohol; and low boiling halohydrocarbons such as 1-chloro-1,1-difluoroethane, pentafluoroethane, 1,1,1,2-tetrafluoroethane, and 1,1-difluoroethane. Such foaming agents can be used alone or in combinations of two or more. The foaming agents can be combined in such a way that both decomposing types of foaming agents and physical foaming agents are used together, and inorganic and organic types are used together. The use of decomposing types with physical types has the effect of regulating the cell diameter.

Incidentally, examples of methods for ensuring that the amount of foaming agent left over in the foam forming the diaphragm is within the aforementioned ranges include the selection of foaming agents with different gas permeation rates, the control of the percentage of open cells in said foam or the foam sheet, and the control of the period for which the foam sheet ages.

The amount of foaming agent that is used varies depending on the type of foaming agent and the intended density of the foam sheet. Preliminary tests are preferably conducted on the foaming agents that are to be used to determine in advance the range for the amount of foaming agent used to obtain foam sheet with a density of 0.03 to 0.6 $g/cm^3$. A guide for the amount of foaming agent added to obtain a foam sheet with a density of 0.06 to 0.35 $g/cm^3$, which is preferred for forming of speaker diaphragms, is 0.5 to 10 weight parts organic physical foaming agent and 0.2 to 3.0 weight parts in the case of inorganic physical foaming agent, per 100 weight parts in the case of base resin.

Examples of cell nucleating agents include inorganic powders such as talc or silica, acidic salts of multivalent carboxylic acids, or reaction mixtures of multivalent carboxylic acids and sodium carbonate or sodium bicarbonate, etc. Cell nucleating agents are preferably added in an amount of about 0.025 to 5 weight parts per 100 weight parts base resin. In addition, additives such as heat stabilizers, UV absorbents, antioxidants, and colorants can also be added as desired if needed.

In the present invention, the speaker diaphragm 1 may have a non-foaming thermoplastic resin film or sheet laminated to at least one side of the aforementioned aromatic polycarbonate resin foam. Examples of such non-foaming thermoplastic resin films and sheets include films and sheets of polycarbonate resins, polystyrene resins, polyethylene resins, polypropylene resins, polycaprolactone resins, methacrylic acid resins, polyethylene terephthalate, polybutylene terephthalate and other polyester resins, acrylonitrile-butadiene-styrene copolymers, methacrylic acid-butadiene-styrene copolymers, styrene-maleic acid copolymers, styrene-acrylic acid copolymers, styrene-acrylate ester-styrene block copolymers, styrene-butadiene-styrene copolymers, styrene-isoprene-styrene block copolymers, styrene-ethylene-butylene-styrene block copolymers, and styrene-ethylene-propylene-styrene block copolymers. The aromatic polycarbonate resin foam and the non-foaming thermoplastic resin film or sheet can be laminated by an adhesive, hot fusion, or the like.

The speaker diaphragm 1 may also be provided with a colored layer. Complexes can also be formed with materials conventionally used as speaker diaphragms. The diaphragm 1 can be obtained when an aromatic polycarbonate resin foam sheet or plate is punched, pressed, and formed such as by thermoforming or the like using a die or a mold to produce the desired shape such as a circular, rectangular, amorphous, flat, or speaker cone shape. When a complex is formed of the aromatic polycarbonate resin foam and another material, then the non-foaming thermoplastic film or sheet laminated to the foam, a coloring layer, materials conventionally used in speaker diaphragms, and the like can be simultaneously provided when the aromatic polycarbonate foam sheet or plate is processed into a speaker diaphragm shape.

The speaker unit 2 of the present invention, which comprises a speaker diaphragm 1 and a mechanism for driving the diaphragm, can be obtained by a method in which a voice coil 6 is attached to the speaker diaphragm 1, which is supported on a frame 3 by a damper 5 and edge 4 or the like, and a magnet 8, plate 9, yoke 10, pole 11, and the like are integrally assembled, etc. The speaker unit 2 can also be attached to a cabinet comprising wood, metal, synthetic resin, foamed resin, a combination thereof, or the like, giving a speaker system. The speaker system may have one, two, or more speaker units. Systems featuring the use of a plurality of speaker units may be one-way systems using a plurality of full range types of units, or multiway systems using a combination of a plurality of speaker units with differing reception bands. The cabinet is not limited to the rear-open type or closed types, but can also include front-horn loaded types, back-horn loaded types, bus reflex types, and the like. Sound-absorbing material, reinforcing material, and the like may be provided in the interior of the cabinet, and frequency splitter circuit networks or the like may be provided in the case of multiway systems.

EXAMPLES

The present invention is illustrated further below with reference to examples.

Example 1

A diaphragm was produced when a sheet of the aromatic polycarbonate resin foam shown in Table 1, which was obtained by extrusion and foaming of aromatic polycarbonate resin derived from bisphenol A (IB2500 by Idemitsu Petrochemical; viscosity average molecular weight 29,000), was heated and formed into a speaker cone. The resulting diaphragm was light-weight, with a thickness of 2.8 mm, a density of 0.25 g/cm$^3$, and a percentage of open cells of 21%. A speaker unit featuring the use of this diaphragm was attached to a synthetic resin cabinet to produce a speaker system. The resulting speaker system suffered no acoustic deterioration as a result of changes in temperature. The amount of remained foaming agent was determined by gas chromatography with an internal reference method using cyclopentane as the internal reference. The measurement device was a Shimadzu Gas Chromatograph GC-14B, which was used under the following conditions.

column temperature: 40° C.
inlet temperature: 200° C.
detector temperature: 200° C.
carrier gas: nitrogen
carrier gas flow rate: 3.5 mL/min
column: Shinwa Chemical Industries, Ltd. Silicone DC550 20%
column length: 4.1 m
column inside diameter: 3.2 mm
support: Chromosorb AW-DMCS
mesh: 60 to 80
detector: FID
solvent for preparation of sample: toluene Incidentally, the amount of foaming agent left over in the foam forming the diaphragm which was obtained in Example 1 was 0.04 mol/kg.

TABLE 1

| | Example 1 | Comparative Example 1 | Comparative Example 2 |
|---|---|---|---|
| Density (g/cm$^3$) | 0.24 | 0.23 | 0.20 |
| Thickness (mm) | 3.0 | 3.0 | 1.5 |
| Elastic modulus in tension (MPa) | | | |
| 25° C. | 2.4 | 1.8 | 2.6 |
| 50° C. | 2.3 | 1.2 | 2.4 |
| 80° C. | 2.1 | 0.7 | not able to measure |
| 105° C. | 1.8 | 0.3 | not able to measure |
| Internal loss: tanδ | | | |
| 25° C. | 0.03 | 0.11 | 0.07 |
| 50° C. | 0.031 | 0.12 | 0.08 |
| 80° C. | 0.041 | 0.14 | 0.13 |
| 105° C. | 0.06 | 0.15 | not able to measure |
| Cell Diameter (μm) | | | |
| Widthwise direction | 520 | 850 | 150 |
| Extrusion direction | 550 | 980 | 190 |
| Amount of foaming agent left over (mol/kg) | 0.1 | not measured | not measured |
| Percentage of open cells (%) | 21 | 20 | 5 |

Comparative Example 1

A cone-shaped speaker diaphragm was formed in the same manner as in Example 1 from the foamed sheet in Table 1, which was obtained by foaming polypropylene resin (PF-814 by Montel SDK Sunrise). A speaker system was assembled in the same manner as in Example 1 with a speaker unit similar to that in Example 1 using the diaphragm of this comparative example. The resulting speaker system was found to suffer from acoustic deterioration as a result of changes in temperature.

Comparative Example 2

A cone-shaped speaker diaphragm was formed in the same manner as in Example 1 from the foamed sheet in Table 1, which was obtained using polystyrene resin (HH32 by Idemitsu Petrochemical). Although the resulting diaphragm was light-weight, it could not be used at elevated temperature.

As noted above, the speaker unit of the present invention has a light-weight diaphragm with a high elastic modulus, as well as excellent properties with virtually no change in the elastic modulus or internal loss due to temperature, making it less susceptible to changes in acoustics with changes in temperature. The speaker unit and speaker system of the present invention thus are suitable for connection to high-output amps, car stereos, and so forth.

What is claimed is:

1. A speaker unit, comprising:

a diaphragm and a mechanism for driving the diaphragm, said diaphragm formed into a foam sheet or plate of aromatic polycarbonate resin having a 0.5 to 10 mm thickness, a density of 0.03 to 0.6 g/cm$^3$, an elastic modulus in tension of said foam sheet or plate of at least 1 MPa at temperatures of 25° C., 50° C., 80° C. and 105° C., and a tan δ of said foam sheet or plate at least 0.02 at a temperature ranging from 25 to 105° C. during measurement of the dynamic viscoelasticity in bending tests giving 1 Hz frequency oscillation strain.

2. The speaker unit according to claim 1, wherein the foam sheet cell or plate has a mean cell diameter of 0.05 to 1 mm, and the amount of foaming agent left over in the foam forming said diaphragm is no more than 0.3 mol/kg.

3. The speaker unit according to claim 1, wherein the aromatic polycarbonate resin forming the diaphragm is an aromatic polycarbonate resin derived from bisphenol.

4. The speaker unit according to claim 1, wherein the aromatic polycarbonate resin forming the diaphragm is an aromatic polycarbonate resin with a viscosity average molecular weight of 25,000 to 70,000.

5. The speaker unit according to claim 1, wherein the percentage of open cells in the aromatic polycarbonate resin foam forming the diaphragm is no more than 50%.

6. The speaker unit according to claim 1, further comprising:

an unfoamed thermoplastic resin laminated to at least one side of said foam sheet or plate of aromatic polycarbonate resin.

7. The speaker unit of claim 1 attached to a cabinet.

8. A method for manufacturing a speaker diaphragm, comprising the steps of:

forming a 0.5 to 10 mm thick aromatic polycarbonate resin foam sheet or plate with a density of 0.03 to 0.6 g/cm and an elastic modulus in tension of at least 1 MPa at temperatures of 25° C., 50° C., 80° C. and 105° C., and a tan δ of at least 0.02 at a temperature ranging from 25 to 105° C. during measurement of the dynamic viscoelasticity in bending tests giving 1 Hz frequency oscillation strain.

9. The speaker unit of claim 1 attached to a cabinet.

10. The speaker unit of claim 2 attached to a cabinet.

11. The speaker unit of claim 3, attached to a cabinet.

12. The speaker unit of claim 4 attached to a cabinet.

13. The speaker unit of claim 5 attached to a cabinet.

* * * * *